United States Patent [19]

Nikolov et al.

[11] 4,116,683

[45] Sep. 26, 1978

[54] NICKEL-FREE AUSTENITIC CORROSION-RESISTANT STEEL

[75] Inventors: Ivan Dimov Nikolov; Tzolo Valkov Rashev; Rangel Petrov Ivanov; Chavdar Andreev Andreev, all of Sofia, Bulgaria

[73] Assignee: Institute po Metaloznanie i Technologia na Metalite, Sofia, Bulgaria

[21] Appl. No.: 790,537

[22] Filed: Apr. 25, 1977

Related U.S. Application Data

[63] Continuation-in-part of Ser. No. 672,339, Mar. 31, 1976, abandoned, which is a continuation of Ser. No. 459,191, Apr. 8, 1974, abandoned.

[30] Foreign Application Priority Data

Apr. 11, 1973 [BG] Bulgaria ..... 23260

[51] Int. Cl.[2] ..... C22C 38/20; C22C 38/38

[52] U.S. Cl. ..... 75/125; 75/126 B; 75/126 J

[58] Field of Search ..... 75/125, 126 B, 126 J

[56] References Cited

U.S. PATENT DOCUMENTS

| | | | |
|---|---|---|---|
| 2,862,812 | 12/1958 | Dulis et al. | 75/125 |
| 3,075,839 | 1/1963 | Dulis et al. | 75/126 J |
| 3,936,297 | 2/1976 | Hartline | 75/126 B |

*Primary Examiner*—Arthur J. Steiner
*Attorney, Agent, or Firm*—Karl F. Ross

[57] ABSTRACT

A nickel-free corrosion-resistant steel which consists by weight of:

carbon ≦ 0.08%
silicon ≦ 0.9%
chromium = 18.05 to 22%
manganese = 6.0 to 10.5%
nitrogen = 0.40 to 1.10%
sulfur ≦ 0.025%
phosphorus ≦ 0.035%
copper ≦ 3% and the remainder iron.

4 Claims, No Drawings

NICKEL-FREE AUSTENITIC CORROSION-RESISTANT STEEL

CROSS-REFERENCE TO RELATED APPLICATION

This application is a continuation-in-part of Ser. No. 679,339 (now abandoned) filed Mar. 31, 1976 as a continuation of Ser. No. 459,191 filed Apr. 8, 1974 (now abandoned).

FIELD OF THE INVENTION

This invention relates to a corrosion-resistant steel, which can be used for the production of high-strength rolled or cast products, intended to be effective in corrosive media.

BACKGROUND OF THE INVENTION

Known corrosion-resistant steels contain nickel, which is necessary in order to obtain an austenitic structure of the steels. A substantial disadvantage of those steels is their low yield strength. Moreover, nickel is expensive and of short supply. The known nickelless steels do not possess sufficient corrosion resistance, have certain poor mechanical properties or have undesirable crystallographic or grain structure. See U.S. Pat. No. 2,862,812, No. 3,075,839, No. 3,893,850 and No. 3,936,297.

OBJECTS OF THE INVENTION

It is therefore the object of the present invention to provide a high-quality corrosion-resistant steel which does not contain any nickel and has a higher strength than that of the known nickel-containing or nickel-free steels, or with improved corrosion resistance in oxidizing media.

DESCRIPTION OF THE INVENTION

According to the present invention this is achieved by alloying a special chromium-manganese nickel-free steel with nitrogen. The corrosion-resistant steel contains these elements in the following weight concentrations: chromium 18.05 to 22%, manganese 6.0 to 10.5% and nitrogen 0.40 to 1.10%.

The content of the remaining elements in the steel, apart from iron, should be as follows: carbon $\leqq$ 0.08%; sulphur $\leqq$ 0.025%; phosphorus $\leqq$ 0.035%; silicon $\leqq$ 0.9% and copper $\leqq$ 3%.

Preferably in % by weight:

$0.035 \leqq C \leqq 0.085$ $0.0 \leqq Mn \leqq 9.0$ $18.05 \leqq C_r \leqq 21.0$ $0.50 \leqq N \leqq 0.90$ A steel of such composition possesses an optimal combination of properties after quenching from 1100° to 1150° C in water. After heat treatment its structure is austenitic and its properties are as follows:

Tensile strength 70 to 130 kgf/mm$^2$; yield strength 40 to 60 kgf/mm$^2$; relative elongation 80 to 20%; and impact toughness 30 to 10 kgf.m/cm$^2$.

The loss in weight in boiling 65% nitric acid is lower than 1.8 g/m$^2$. hour. The steel is absolutely resistant in a solution of boiling sulphuric acid and copper sulphate, as well as to atmospheric corrosion at 35° C and 95% air humidity.

SPECIFIC EXAMPLES

EXAMPLE I

A corrosion-resistant steel containing: carbon 0.04%; silicon 0.70%; chromium 20.3%; manganese 8.80%; nitrogen 0.604%; sulphur 0.020%; phosphorus 0.020%; copper 0.30% ins quenched after rolling at 1150° C in water; it has a tensile strength of 101.1 kgf/mm$^2$; a yield strength of 57.2 kgf/mm$^2$; a relative elongation of 49.4%; an impact toughness at 20° C equal to 19.2 kgf/cm$^2$; and a loss in weight in boiling 65% nitric acid less than 1.40 g/m$^2$ hour. The steel is absolutely resistant in a solution of boiling sulphuric acid and copper sulphate, as well as to atmospheric corrosion at 35° C and 95% air humidity.

EXAMPLE II

A corrosion-resistant steel consisting essentially of 0.08% by weight C

~0.7% by weight Si 18.06% by weight Cr 8.80% by weight Mn 0.59% by weight N 0.01–0.025% by weight S 0.01–0.025% by weight P ~0.3% by weight Cu Balance iron, is formed by casting an ingot, rolling at 1150° C and quenching in water. It has a tensile strength of 105 kgf/mm$^2$ (kilograms-force per square millimeter), a yield strength of 58.6 kgf/mm$^2$, a relative elongation (5%) of 53% and a loss of weight in fuming nitric acid (65%) of 1.08 g/m$^2$.

EXAMPLE III

A corrosion-resistant steel consisting essentially of 0.06% by weight C ~0.7% by weight Si 20.30% by weight Cr 8.10% by weight Mn 0.861% by weight N ~0.02% by weight S ~0.02% by weight P ~0.3% by weight Cu Balance iron, is formed by casting an ingot, rolling at 1150° C and quenched in water.

It has a tensile strength of 117.1 kgf/mm$^2$(kilograms-force per square millimeter), a yield strength of 60.5 kgf/mm$^2$, a relative elongation (5%) of 45.5% and a loss of weight in fuming nitric acid (65%) of 0.59 g/m$^2$.

We claim:

1. A nickel-free corrosion-resistant steel which consists by weight of:

0.035% $\leqq$ carbon $\leqq$ 0.08%

18.05% $\leqq$ chromium $\leqq$ 21.0%

8.0% $\leqq$ manganese $\leqq$ 9.0%

0.50% $\leqq$ nitrogen $\leqq$ 0.90% silicon $\leqq$ 0.9% sulfur $\leqq$ 0.025% phosphorus $\leqq$ 0.035% copper $\leqq$ 3% and the remainder being iron.

2. A nickel-free corrosion-resistant steel as defined in claim 1 wherein:

C = 0.08% by weight,

Mn = 8.80% by weight,

Cr = 18.06% by weight, and

N = 0.590% by weight.

3. A nickel-free corrosion-resistant steel as defined in claim 1 wherein:

C = 0.04% by weight,
Mn = 8.80% by weight,
Cr = 20.30% by weight, and
N = 0.604% by weight.

4. A nickel-free corrosion-resistant steel as defined in claim 1 wherein:

C = 0.06% by weight,
Mn = 8.10% by weight,
Cr = 20.30% by weight, and
N = 0.861% by weight.

* * * * *